US009581333B2

(12) United States Patent
Fioriti et al.

(10) Patent No.: US 9,581,333 B2
(45) Date of Patent: Feb. 28, 2017

(54) IGNITER ASSEMBLY AND METHOD FOR OPERATING

(71) Applicant: Aerco International, Inc., Blauvelt, NY (US)

(72) Inventors: Gerald A. Fioriti, Rock Tavern, NY (US); Craig Evans, Westwood, NJ (US); Hakan Bjornson, Sparta, NJ (US)

(73) Assignee: Aerco International, Inc., Blauvelt, NY (US)

( * ) Notice: Subject to any disclaimer, the term of this patent is extended or adjusted under 35 U.S.C. 154(b) by 632 days.

(21) Appl. No.: 13/875,003

(22) Filed: May 1, 2013

(65) Prior Publication Data

US 2013/0295510 A1 Nov. 7, 2013

Related U.S. Application Data

(60) Provisional application No. 61/641,244, filed on May 1, 2012.

(51) Int. Cl.
*F23Q 3/00* (2006.01)

(52) U.S. Cl.
CPC ..... *F23Q 3/008* (2013.01); *F23Q 3/00* (2013.01)

(58) Field of Classification Search
CPC ..... F23Q 3/008; F23Q 3/00
USPC ..... 431/264, 255, 258
See application file for complete search history.

(56) References Cited

U.S. PATENT DOCUMENTS

| | | | | |
|---|---|---|---|---|
| 3,729,288 | A * | 4/1973 | Berlincourt | F23Q 2/287 431/264 |
| 4,325,690 | A * | 4/1982 | Hayes | F23Q 9/04 431/258 |
| 5,729,887 | A * | 3/1998 | Irie | G11B 5/313 29/602.1 |
| 5,902,100 | A * | 5/1999 | Long | F23Q 9/08 431/107 |
| 2010/0183990 | A1* | 7/2010 | Watson | F23C 1/08 431/8 |
| 2012/0227407 | A1* | 9/2012 | Reiss | F23R 3/286 60/737 |

* cited by examiner

*Primary Examiner* — Avinash Savani
*Assistant Examiner* — Aaron Heyamoto
(74) *Attorney, Agent, or Firm* — Harris Beach PLLC

(57) ABSTRACT

An igniter assembly includes a bushing for installation in a burner. The bushing has a proximal end and an opposing distal end. A gas tube is secured through a central portion of the bushing, and an electrode assembly is secured through the central portion of the bushing. The electrode assembly includes an electrically conductive conductor element and an insulator element in surrounding relationship to the conductor element. The igniter assembly further includes a flame holder element secured to a distal end of the electrode assembly, and a ground rod secured to the electrode assembly. A distal end of the ground rod defines a spark gap with the flame holder element.

12 Claims, 4 Drawing Sheets

IGNITER ASSEMBLY AND METHOD FOR OPERATING

CROSS REFERENCE TO RELATED APPLICATION

Reference is made to and this application claims priority from and the benefit of U.S. Provisional Application Ser. No. 61/641,244, filed May 1, 2012, entitled "IGNITER FOR A WATER HEATING SYSTEM", which application is incorporated herein in its entirety by reference.

FIELD OF THE INVENTION

This disclosure relates generally to an igniter and, more specifically, to an igniter for a water heater that operates over a wide range of water heater operating conditions.

BACKGROUND OF THE INVENTION

Despite continuing improvements in the fuel efficiency of and reduction in undesirable operating emissions therefrom, modern fuel-fired water heaters still have various operational characteristics which are less than entirely satisfactory. For example, the burner pilots in most if not all conventional fuel-fired water heaters draw their combustion air from the area within the combustion chamber surrounding the pilot burner and its associated main burner. In some water heater combustion chamber configurations this air surrounding the pilot is diluted with exhaust gases. This undesirably reduces the amount of available oxygen for proper pilot combustion.

Another design challenge associated with modern fuel-fired water heaters is that the operating conditions can vary among the facility installations. That is, the fuel supply pressure for the igniter may vary from installation to installation, causing different combustion characteristics.

SUMMARY OF THE INVENTION

As can be seen from the foregoing, a need exists for a fuel-fired water heater having improvements in the above-described areas. It is to this need that the present invention is primarily directed.

In accordance with one aspect of the disclosure, an igniter assembly includes a bushing for installation in a burner. The bushing has a proximal end and an opposing distal end. A gas tube is secured through a central portion of the bushing, and an electrode assembly is secured through the central portion of the bushing. The electrode assembly includes an electrically conductive conductor element and an insulator element in surrounding relationship to the conductor element. The igniter assembly further includes a flame holder element secured to a distal end of the electrode assembly, and a ground rod secured to the electrode assembly. A distal end of the ground rod defines a spark gap with the flame holder element.

In accordance with another aspect of the disclosure, a method for operating an igniter assembly is provided. The method includes the steps of providing a bushing for installation in a burner, and securing an electrode assembly through a central portion of the bushing. The electrode assembly includes a conductor element and an insulator element in surrounding relationship to the conductor element. The method further includes the steps of securing a flame holder element to a distal end of the electrode assembly, securing a ground rod to the electrode assembly, and positioning a distal end of the ground rod in proximity to the flame holder element to define a spark gap. The method further includes the steps of securing a gas tube through the central portion of the bushing, and positioning a distal end of the gas tube a distance away from the spark gap to define a mixing distance. The method further includes the steps of energizing the electrode assembly to create a spark across the spark gap, flowing a fuel from the gas tube, mixing the fuel with surrounding air, igniting the fuel/air mixture to form a flame front, and holding the flame front on the flame holder element.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
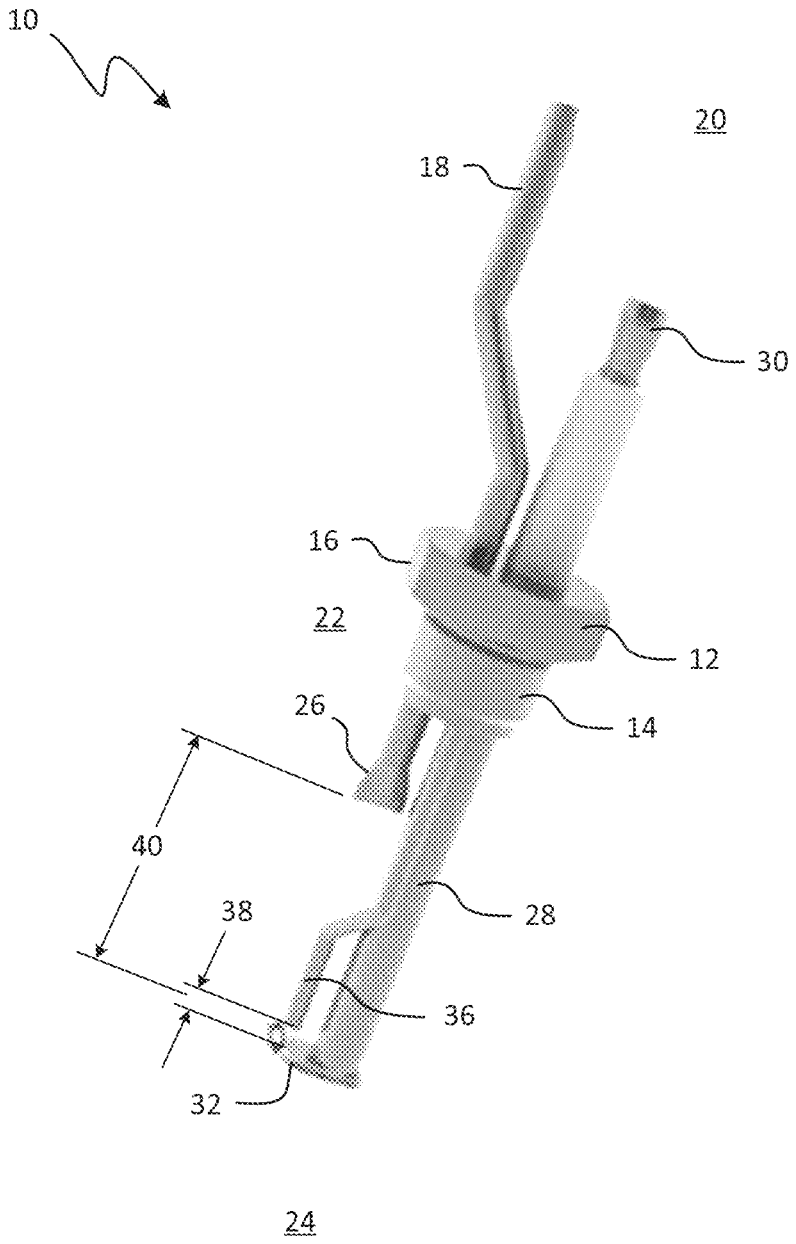
FIG. 1 depicts a perspective view of an igniter assembly in accordance with one embodiment of the present invention.
Figure 2:
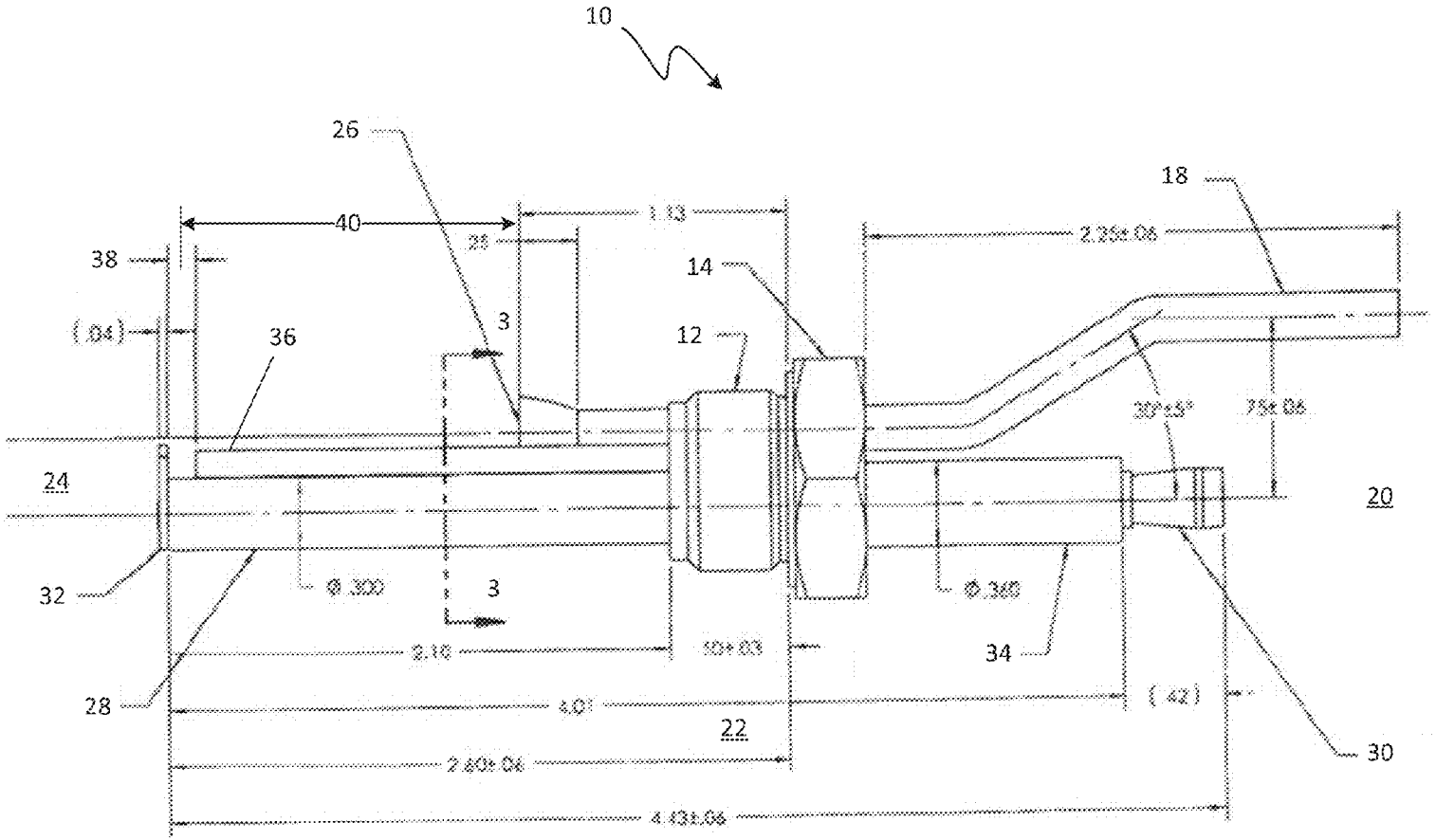
FIG. 2 depicts a side plan view of the igniter assembly shown in FIG. 1.
Figure 3:
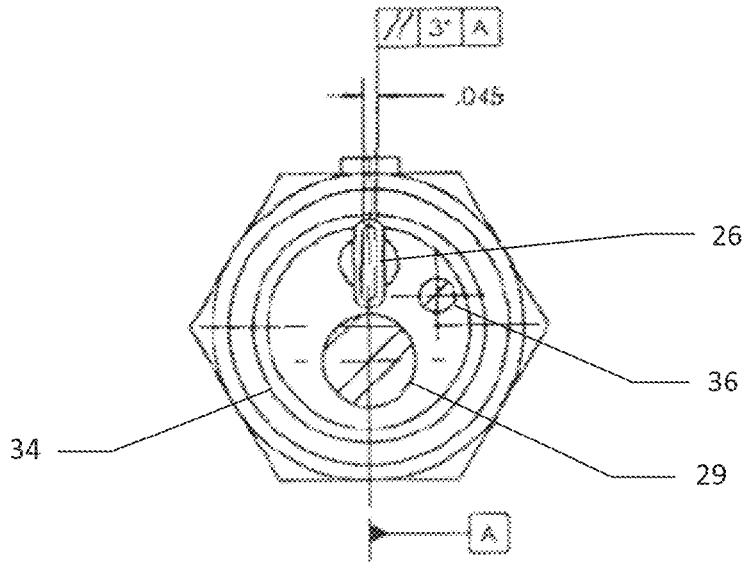
FIG. 3 depicts a cross-sectional end view of the igniter assembly shown in FIG. 2, viewed towards the proximal end.

Referring to FIGS. 1-4, an igniter assembly 10 includes a bushing 12 to enable installation into the burner region of a water heating system. The bushing 12 includes mounting threads 14 which in one embodiment can be 0.750-20 UN-2A external threads. The bushing 12 further includes hex-shaped wrenching flats 16 on an external surface thereof to facilitate installation. The bushing 12 is further adapted to provide electrical grounding, described herein below. The bushing 12 may be formed of any material suitable for its intended use, such as 300 series stainless steel.

The igniter assembly 10 further includes a gas tube 18 for delivering gaseous fuel to the ignition site. In one embodiment, the gas tube 18 is formed of 0.190 inch diameter, 0.035 inch wall thickness 310-series stainless steel tubing. In another embodiment, the gas tube 18 is formed from an iron-chromium-aluminum (FeCrAl) alloy such as Kanthal® D, known for its ability to withstand high temperatures and having intermediate electric resistance. The gas tube 18 includes a proximal end 20 for connection to a fuel supply, an intermediate portion 22 that passes through and is sealed to the bushing 12, and a distal end 24 that is exposed to the combustion. In one embodiment of the invention, the distal end of the gas tube 18 includes a jetting element 26 that is adapted to provide a high velocity gas jet. The intermediate portion 22 may be sealed to the bushing 12 using URC Uni-Lam 1069 resin and TP-41 hardener, for example. In one embodiment, the jetting element 26 comprises a tube with a flattened tip that forms a 0.045 inch wide, vertically-oriented oval gap or slot for the gas to flow through. The jetting element 26 (e.g., slot) can function as a flow orifice to provide a non-linear pressure drop. In other words, as the velocity of the gaseous fuel increases, the pressure drop rises more than linearly. In this manner, better flow stability is achieved in high pressure applications.

The igniter assembly 10 further includes an electrode assembly 28 to deliver high voltage to the distal end 24 of the igniter assembly 10. In the illustrated embodiment, the proximal end 20 of the electrode assembly 28 includes a terminal nut 30 adapted to receive a spark plug wire. The electrode assembly 28 includes a conductor element 29 which may be formed of any electrically conductive material suited for its intended purpose, such as copper.

The igniter assembly 10 further includes a flame holder element 32 coupled to the distal end 24 of the electrode assembly 28. In one embodiment, the flame holder element 32 is a flat tab formed of Kanthal® D. The inventors have learned that the size and location of the flame holder element 32 is important to the robust operation of the igniter assembly 10. In one respect, if the flame holder element 32 is too big (e.g., wide and/or tall), the flame will simply spread or fan out and will not have sufficient energy to reach the spark. If the flame holder element 32 is too small, it won't hold the flame.

The electrode assembly 28 further includes an insulator element 34, such as alumina oxide (e.g., ceramic), in surrounding relationship to the conductor element of the electrode assembly 28. The insulator element 34 prevents the current that is delivered to the terminal nut 30 from flowing into the bushing 12. The insulator element 34 passes through and is sealed to the bushing 12. In one example, the insulator element 34 can be sealed to the bushing 12 using URC Uni-Lam 1069 resin and TP-41 hardener.

The igniter assembly 10 further includes a ground rod 36 to provide electrical grounding of the spark created in the ignition process. The ground rod 36 includes a proximal end 20 that may be welded to the bushing 12, for example, and a distal end 24 that sets the spark gap 38. The ground rod 36 may be formed of a high temperature-resistant electrical conductor, such as Kanthal, for example. In one embodiment, the ground rod 36 is straight and projects in cantilever fashion from the bushing 12. One noted improvement to the ground rod 36 is that the spark gap 38 does not appreciably change if the rod were to deform due to heat or thermal stress in the burner area. If the ground rod 36 moved to the left, right, up, or down, it doesn't lose its ability to collect the spark to ground. In fact, the inventors have devised the arrangement of the ground rod 36 relative to the flame holder element 32 such that it may deform in any direction up to 0.25 inches and still perform its function. Prior art ground rods tend to close down the spark gap when deformed, such that the new gap causes a short or no spark at all.

In operation, a spark plug wire (not shown) when energized supplies an electrical voltage (e.g., 15.6 kV) that is carried down the conductor element 29 to the flame holder element 32. A high voltage potential develops across the flame holder element 32 and the ground rod 36, resulting in a sustained electrical arc or spark across the spark gap 38. Gaseous fuel is supplied to the gas tube 18, and flows through the jetting element 26 where it is accelerated and mixed with the surrounding air in the burner chamber (not shown). The jetting element 26 creates a high velocity gas jet that promotes rapid mixing with the surrounding air prior to encountering the spark igniter. The fuel jet travels across a mixing distance 40 that provides sufficient distance to thoroughly mix the fuel with the air to achieve a mixture ratio that alleviates formation of soot on the flame holder element 32. In the illustrated embodiment, the fuel/air mixture impinges off the flame holder element 32, loses a portion of its energy, and is diverted off the flame holder through the spark at a lower velocity. Thus, the combination of elements in the disclosed igniter assembly 10 provides for a high velocity fuel supply to promote rapid mixing, and a lower velocity at the spark site to promote stable combustion.

Thus, one important aspect of the present invention is the mixing distance 40 between the jetting element 26 at the distal end 24 of the gas tube 18 and the location of the spark. In one embodiment, a distance of about 1.3 inches to 1.6 inches has provided excellent results. The mixing distance 40 allows a good mix before the combustible mixture hits the spark and the flame holder, which prevents soot from depositing around the area where the spark occurs, on the upper side of the flame holder, and parts in that area.

Figure 4:
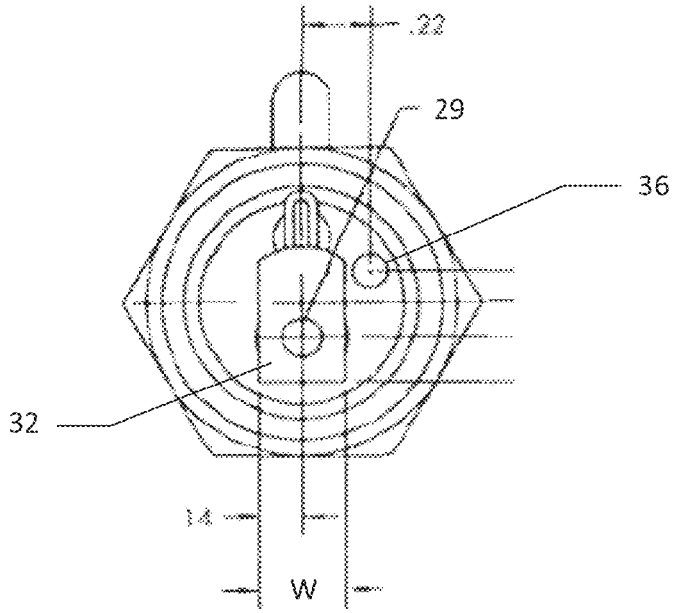
FIG. 4 depicts an end view of the igniter assembly shown in FIG. 2, viewed from the distal end towards the proximal end.

As can be appreciated with reference to FIG. 4, the flame holder element 32 blocks a portion, but not all, of the gas jet flowing from the gas tube 18. In the illustrated embodiment, approximately 50% of the gas jet does not impinge on the flame holder element 32. The inventors have discovered that, in order to operate the igniter assembly 10 at a broad range of gas supply pressures, a balance must be struck between the size of the flame holder element 32 and the degree or amount that the gas jet impinges upon it. In other words, the size of the flame holder element 32 and the percent of gas impingement correlates to how much pressure variation can be tolerated in the fuel gas supply. This is important because the gas supply pressure can vary from 4-56 inches water column due to site supply, loss of upstream pressure regulating components, etc. Current testing of one embodiment of the igniter assembly 10 indicates stable and robust operation over the entire range. For example, testing indicates that at a gas supply pressure of approximately 2 psi, an acceptable arrangement comprises approximately 50% impingement of the gas jet on a flame holder element 32 that is 0.28 inches wide. In this configuration, the flame holder element 32 just holds the flame.

Figure 5:
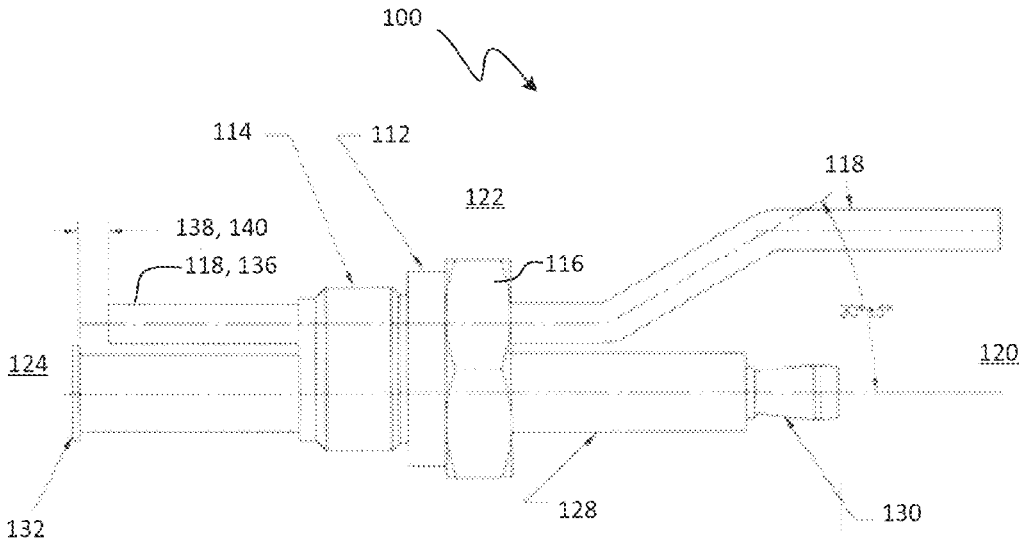
FIG. 5 depicts a side plan view of an igniter assembly in accordance with another embodiment of the present invention.
Figure 6:
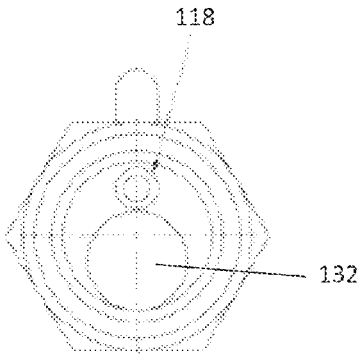
FIG. 6 depicts an end view of the igniter assembly shown in FIG. 5, viewed from the distal end towards the proximal end.

Turning now to FIGS. 5-6, wherein like numerals indicate like elements from FIGS. 1-4, an igniter assembly 110 is shown according to another embodiment of the invention. The igniter assembly 110 minimizes extra parts and manufacturing cost, and in some examples can be retrofit to existing spark plug direct ignition components.

The igniter assembly 110 includes a bushing 112 to enable installation into the burner region of a water heating system. The bushing 112 includes mounting threads 114 which in one embodiment can be 0.750-20 UN-2A external threads. The bushing 112 further includes hex-shaped wrenching flats 116 on an external surface thereof to facilitate installation. The bushing 112 is further adapted to provide electrical grounding, described herein below. The bushing 112 may be formed of any material suitable for its intended use, such as 300 series stainless steel.

The igniter assembly 110 further includes a gas tube 118 for delivering gaseous fuel to the ignition site. In one embodiment, the gas tube 118 is formed of 0.190 inch diameter, 0.035 inch wall thickness 310-series stainless steel tubing. In another embodiment, the gas tube 118 is formed from an iron-chromium-aluminum (FeCrAl) alloy such as Kanthal® D, known for its ability to withstand high temperatures and having intermediate electric resistance. The gas tube 118 includes a proximal end 120 for connection to a fuel supply, an intermediate portion 122 that passes through and is sealed to the bushing 112, and a distal end 124 that is exposed to the combustion. The intermediate portion 122 may be sealed to the bushing 112 using URC Uni-Lam 1069 resin and TP-41 hardener, for example.

The igniter assembly 110 further includes an electrode assembly 128 to deliver high voltage to the distal end 124 of the igniter assembly 110. In the illustrated embodiment, the proximal end 120 of the electrode assembly 128 includes a terminal nut 130 adapted to receive a spark plug wire. The electrode assembly 128 includes a conductor element (not shown) which may be formed of any electrically conductive material suited for its intended purpose, such as copper.

The igniter assembly 110 further includes a flame holder element 132 coupled to the distal end 124 of the electrode assembly 128. In one embodiment, the flame holder element 132 is a round disk formed of Kanthal® D. The size and location of the flame holder element 132 is important to the robust operation of the igniter assembly 110. In one embodiment, the flame holder element 132 is positioned proximate to the gaseous stream from the gas tube 118. As shown in FIG. 6, the flame holder element 132 does not block the gas flow from the gas tube 118. However, in other embodiments a partial blockage may be advantageous to the operation of the igniter assembly.

The igniter assembly 110 further includes a ground rod 136 to provide electrical grounding of the spark created in the ignition process. In the illustrated embodiment, the ground rod 136 is also the gas tube 118. The ground rod 136 includes a proximal end 120 that may be welded to the bushing 112, for example, and a distal end 124 that sets the spark gap 138.

In operation, a spark plug wire (not shown) when energized supplies an electrical voltage (e.g., 15.6 kV) that is carried down the electrode assembly 128 to the flame holder element 132. A high voltage potential develops across the flame holder element 132 and the ground rod 136, resulting in a sustained electrical arc or spark across the spark gap 138. Gaseous fuel flows from the gas tube 118, and is mixed with the surrounding air prior to encountering the spark igniter. The air/fuel mixture travels across a mixing distance 140, ignites proximate to the spark, and the flame front is held by the flame holder element 132.

Examples of operational tests of the disclosed igniter assembly 10 include the following:

EXAMPLE 1

Varying the gas pressure in the gas tube as high as 1 psig in an attempt to impede flame stability and detach the flame from the flame holder element. Tested during ignition, and when flame is established. Flame is stable throughout test.

EXAMPLE 2

Forced air horizontally (at positive pressure) at the igniter from approximately 12 inches away, attempting to affect flame stability and detach flame. Tested during ignition, and when flame is established. Flame is stable throughout test.

EXAMPLE 3

Draw air around igniter, causing a negative pressure area around the igniter, in attempt to affect flame stability and detach flame. Tested during ignition, and when flame is established. Flame is stable throughout test.

EXAMPLE 4

Ignition cycle test in succession, checking for carbon buildup. Over 3,500 cycles with no visible carbon appearance.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. An igniter assembly, comprising:

a bushing for installation in a burner, the bushing comprising a proximal end and an opposing distal end;

a gas tube secured through a central portion of the bushing;

a jetting element disposed at a distal end of said gas tube, said jetting element comprising an oval gap or slot;

an electrode assembly secured through the central portion of the bushing, the electrode assembly comprising an electrically conductive conductor element and an insulator element in surrounding relationship to the conductor element;

a flame holder element comprising a tab secured to a distal end of the electrode assembly at about a right angle to the electrode assembly and electrically coupled to the electrically conductive conductor element, the tab oriented perpendicular to a long axis of the jetting element to form a mixing distance from said jetting element; and a ground rod secured to the electrode assembly, a distal end of the ground rod defining a spark gap with the flame holder element.

2. The igniter assembly of claim 1, wherein the mixing distance is greater than 1.3 inches.

3. The igniter assembly of claim 1, wherein the mixing distance is in a range between 1.3 inches and 1.6 inches.

4. The igniter assembly of claim 1, wherein the jetting element comprises a tube with a flattened tip.

5. The igniter assembly of claim 1, wherein the flame holder element is positioned relative to a distal end of the gas tube such that the flame holder element blocks a portion of a gas jet flowing from the gas tube.

6. The igniter assembly of claim 5, wherein the flame holder element blocks approximately 50 percent of the gas jet.

7. The igniter assembly of claim 1, wherein the insulator element is formed of alumina oxide.

8. The igniter assembly of claim 1, wherein said tab comprises about a rectangular shape.

9. An igniter assembly, comprising:

a bushing for installation in a burner, the bushing comprising a proximal end and an opposing distal end;

a gas tube secured through a central portion of the bushing;

a jetting element disposed at a distal end of said gas tube, said jetting element comprising an oval gap or slot;

an electrode assembly secured through the central portion of the bushing, the electrode assembly comprising an electrically conductive conductor element and an insulator element in surrounding relationship to the conductor element;

a flame holder element comprising a tab secured to a distal end of the electrode assembly at about a right angle to the electrode assembly and electrically coupled to the electrically conductive conductor element, the tab oriented perpendicular to a long axis of the jetting element to form a mixing distance from said jetting element; and a ground rod secured to the electrode assembly, a distal end of the ground rod defining a ground side of a spark gap with the flame holder element defining a high voltage side of the spark gap.

10. The igniter assembly of claim 9, wherein said about a rectangular shape comprises three substantially straight sides and one convex curved side.

11. The igniter assembly of claim 8, wherein said tab is mechanically coupled to the distal end of the electrode assembly off-center of the tab.

12. The igniter assembly of claim 10, wherein said convex curved side of said tab extends to about a center line of a distal end of the gas tube.

* * * * *